US005142844A

United States Patent [19]

Frye, Jr.

[11] Patent Number: 5,142,844

[45] Date of Patent: Sep. 1, 1992

[54] TAB MAGAZINE LOADER USING A PIVOT POINT

[75] Inventor: Ronald E. Frye, Jr., Newman, Calif.

[73] Assignee: VLSI Technology, Inc., San Jose, Calif.

[21] Appl. No.: 751,275

[22] Filed: Aug. 29, 1991

[51] Int. Cl.[5] ..... B65B 5/10; B65B 23/20; B65B 35/52

[52] U.S. Cl. ..... 53/475; 53/541; 53/242; 53/244; 414/795.3

[58] Field of Search ..... 53/447, 475, 242, 541, 53/540, 244; 414/795.3, 790.3, 791.5

[56] References Cited

U.S. PATENT DOCUMENTS

| | | | |
|---|---|---|---|
| 2,072,318 | 3/1937 | Staude | 414/795.3 X |
| 3,030,867 | 4/1962 | Wright | 414/795.3 X |
| 4,766,714 | 8/1988 | Sugaya | 53/242 |
| 4,808,054 | 2/1989 | Cuzin | 414/795.3 X |

*Primary Examiner*—Horace M. Culver
*Attorney, Agent, or Firm*—Hickman & King

[57] ABSTRACT

A horizontal force moves a tape-automated-bonded (TAB) carrier along a first horizontal surface so that the leading edge of the TAB carrier is elevated above a second horizontal surface located beneath the open bottom area of the stacking magazine. After the center of gravity of the TAB carrier has passed a pivot line, the TAB carrier is pivoted about the pivot line by the force of gravity and assumes a horizontal position within the open bottom area of the stacking magazine. If the stacking magazine contains one or more previously-loaded TAB carriers, the TAB carrier being inserted into the open bottom area of the stacking magazine pushes upwardly against the lower surface of the lowest previously loaded TAB carrier so that the weight of the one or more previously loaded TAB carriers also helps to pivot the TAB carrier being loaded about the pivot line.

5 Claims, 3 Drawing Sheets

TAB MAGAZINE LOADER USING A PIVOT POINT

BACKGROUND OF THE INVENTION

1. Field of the Invention

This invention relates to apparatus and methods for handling tape-automated-bonded (TAB) integrated circuits and more particularly for loading Tab carriers into a bottom-loading stacking magazine.

2. Prior Art

An inexpensive technique for packaging and automated handling of integrated circuit dies, or chips, is to bond a die to a section of thin, flexible plastic tape material. This packaging technique is called tape-automated bonding, or TAB packaging. Each section of a tape has a conductor pattern formed on it. For testing and handling, each section of tape is connected to a TAB carrier, which is, typically, a thin relatively stiff frame attached to the peripheral edges of a segment of tape.

For storage and handling the carriers are loaded into stacking magazines, in which the TAB carriers are held in vertical stacks. Because the it is intended that the TAB carriers be handled by automated handling devices, there is a need for apparatus and methods for bottom-loading the stacking magazines.

SUMMARY OF THE INVENTION

It is therefore an object of the invention to provide apparatus and methods for loading TAB carriers into stacking magazines.

In accordance with this and other objects of the invention, apparatus is provided for loading a TAB carrier into a bottom-loading stacking magazine. Broadly speaking, the invention contemplates providing a means for applying a horizontal force to the trailing edge of a tab carrier and for moving the TAB carrier along a horizontal surface so that the leading edge of the TAB carrier is elevated above a horizontal surface located beneath the open bottom area of the stacking magazine. After the center of gravity of the TAB carrier has passed a pivot line, the TAB carrier is pivoted about the pivot line by the force of gravity and assumes a horizontal position within the open bottom area of the stacking magazine.

If the stacking magazine already contains one or more previously-loaded TAB carriers, the TAB carrier being inserted into the open bottom area of the stacking magazine pushes upwardly against the lower surface of the lowest previously loaded TAB carrier so that the weight of the one or more previously loaded TAB carriers also helps to pivot the TAB carrier being loaded about the pivot line.

According to one aspect of the invention, the TAB carrier is initially placed on a first horizontal surface and is then moved up a ramp surface to a second horizontal surface, which is elevated above the first horizontal surface and over which is positioned the open bottom area of the stacking magazine. The intersection of the ramp surface and the second horizontal surface forms a pivot line about which a TAB carrier pivots when the center of gravity of the TAB carrier is beyond the pivot line. The force of gravity pivots the TAB carrier about the pivot line and causes the TAB carrier to lie horizontally on the second horizontal surface beneath the open bottom area of the magazine.

The invention also provides a method of loading a TAB carrier into a bottom-loading stacking magazine.

The method includes the steps of: placing a TAB carrier on a first horizontal surface; applying a horizontal force to the trailing edge of the TAB carrier; moving the TAB carrier along the first horizontal surface and along a ramp extending upwardly from the first horizontal surface and into the open bottom area of the stacking magazine to a location where the center of gravity of the TAB carrier is located beyond a pivot line; and pivoting the TAB carrier about the pivot line by the force of gravity so that the TAB carrier lies in a horizontal position on a second horizontal surface beneath the open bottom area of the stacking magazine and so that the TAB carrier takes up a position at the bottom-most position within the stacking magazine.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Reference will now be made in detail to the preferred embodiment of the invention, an example of which is illustrated in the accompanying drawings. While the invention will be described in conjunction with the preferred embodiment, it will be understood that it is not intended to limit the invention to this embodiment. On the contrary, the invention is intended to cover alternatives, modifications and equivalents, which may be included within the spirit and scope of the invention as defined by the appended claims.

Figure 1:
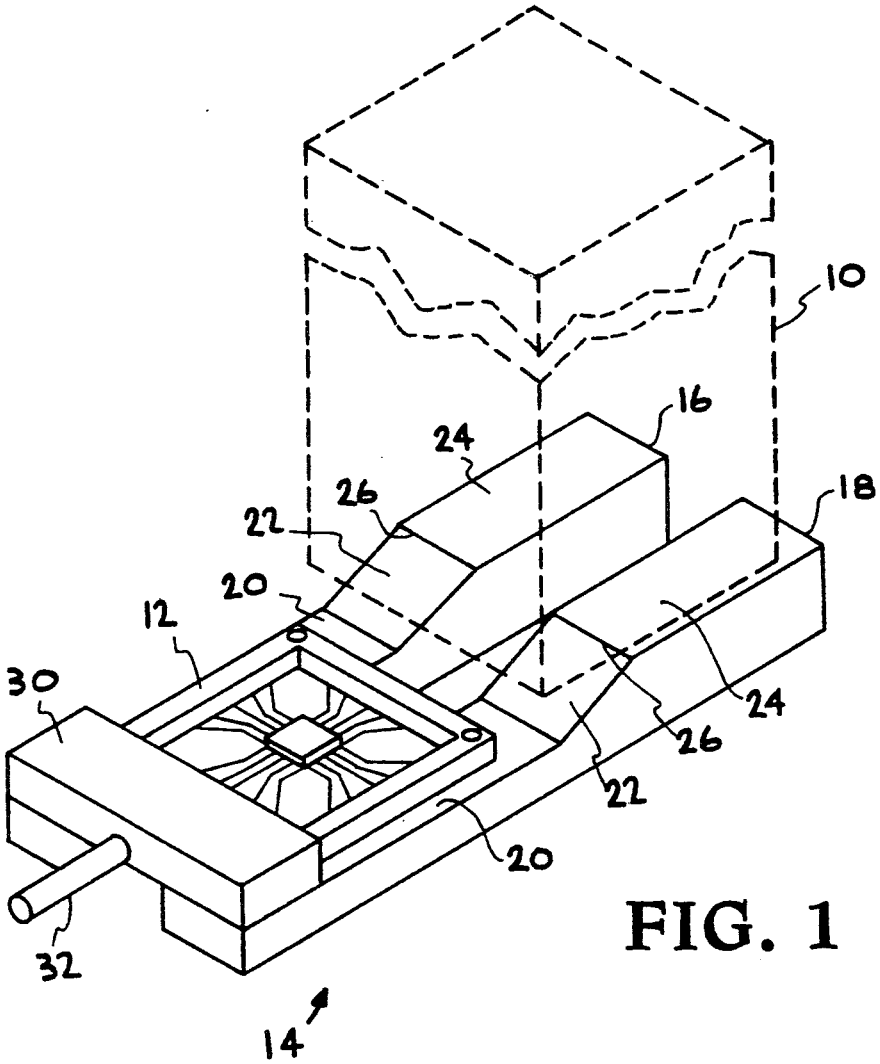
FIG. 1 is a perspective view of a stacking magazine and a loader device for loading TAB carriers into the bottom of a bottom-loading magazie for TAB carriers.

FIG. 1 shows a bottom-loading stacking magazine 10 into which a TAB carrier 12 is to be loaded. To assist in loading the TAB carrier 12 into the stacking magazine 10, the invention provides a loader device 14, which incorporates several working surfaces, or planes, to assist in loading the magazine 10. The working surfaces are formed, for example, as the edge surfaces of two parallel plates 16, 18. A first horizontal surface 20 is formed as two respective surface areas on the plates 16, 18. A ramp surface 22 is also formed as two surfaces areas of the plates 16, 18. Similarly, a second horizontal surface 24 is formed as two surface areas of the plates 16, 18.

A TAB carrier 12 is initially placed on the first horizontal surface 20, as indicated in the figure. The ramp surface 22 extends upwardly away from the first horizontal surface 20. The second horizontal surface 24 lies in a plane above the first horizontal surface 20 and is located beneath the stacking magazine 10.

The line of intersection of the second horizontal surface 24 and the ramp surface 22 is called a pivot line 26. The importance of the pivot line 26 will become evident as operation of the invention is described. It is assumed that the center of gravity (CG) of the TAB carrier 12 is approximately at its geometric center.

A typical TAB carrier 12 is initially loaded onto the first horizontal surface 20 by a handler device which handles the TAB carriers while they are being tested, sorted, and assigned to be loaded in predetermined stacking magazines. The handler is, for example, an automated robot device.

In operation, a continuous horizontal force is exerted on the trailing edge of the TAB carrier 12 by a pusher block 30 connected to a push rod 32 to move the TAB carrier 12 in a direction toward the right side of the drawing. The push rod 32 for the pusher block 30 is moved, for example, by conventional apparatus including mechanical, electrical, pneumatic, hydraulic apparatus, or a combination thereof. As this movement to the right occurs, the TAB carrier 12 is pushed up the ramp 22 from its initial position on the first horizontal surface 20 of the loader device 14 towards the second horizontal surface 24 of the loader device 14.

Figure 2:
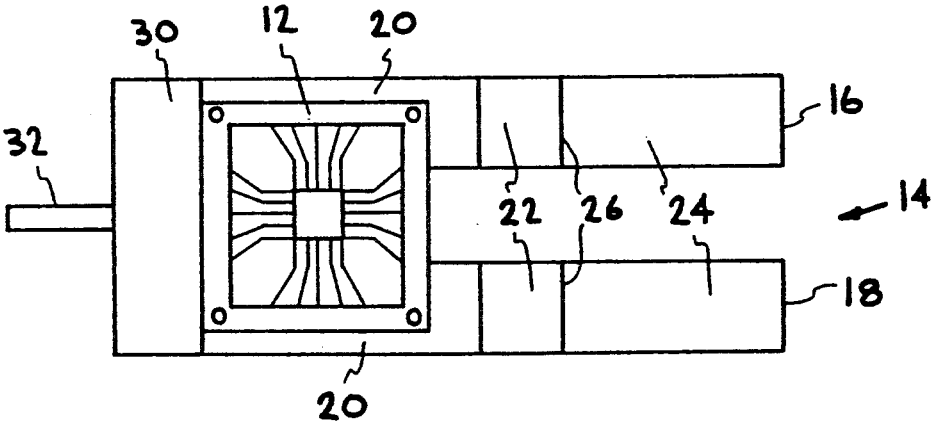
FIG. 2 is a plan view showing a TAB carrier initially loaded on a loader device.

FIG. 2 is a plan view of one embodiment of the invention in which the working surfaces are formed, for example, as the edge surfaces of the two parallel plates 16, 18. The working surfaces can also be formed as continuous surfaces formed on planes of a one-piece loader device, rather than as the edge surfaces of two parallel plates.

Figure 3:
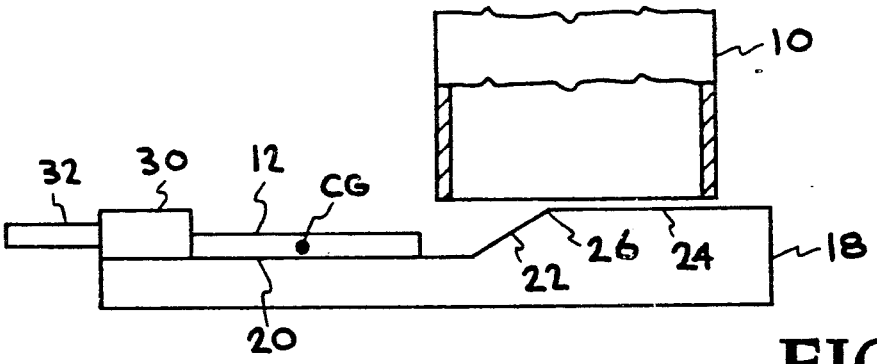
FIG. 3 is an elevational view showing a TAB carrier initially loaded on the first horizontal surface of the loader device.

FIG. 3 is a elevational view showing the TAB carrier 12 initially loaded on the first horizontal surface 20 of the loader device 14.

Figure 4:
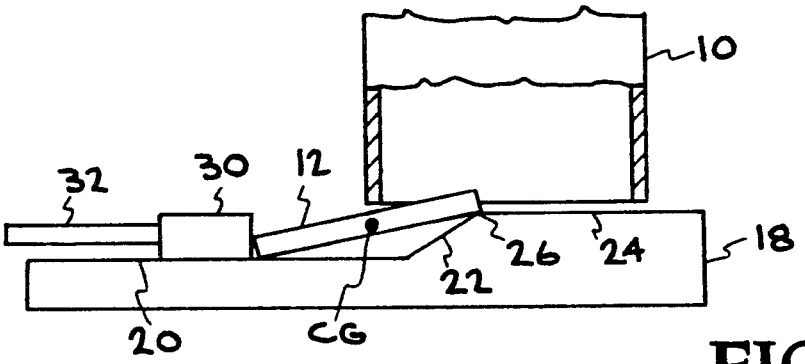
FIG. 4 is an elevational view showing a TAB carrier being initially pushed into the bottom of an empty magazine, where the leading edge of the TAB carrier has just passed the top of a ramp surface connecting the first horizontal surface with an second elevated horizontal surface.

FIG. 4 shows the TAB carrier 12 with its leading edge located just beyond the pivot line 26 at the top of the ramp surface 22. As the TAB carrier 12 continues to be pushed to the right, the lower surface of the TAB carrier 12 passes over the pivot line 26.

Figure 5:
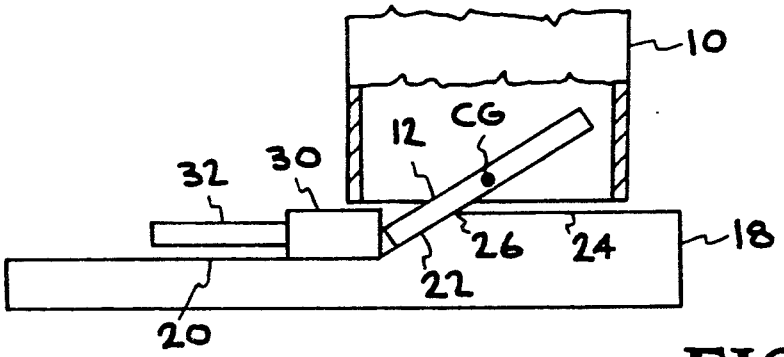
FIG. 5 is an elevational view showing a TAB carrier which has been further pushed into the empty stacking TAB-carrier magazine to the point where the center of the TAB carrier passes a pivot point defined by the top edge of the ramp.

FIG. 5 shows the TAB carrier 12 in an inclined position where its center of gravity has passed to the right of the pivot point 30 at the top of the ramp 28. The force of gravity pulls at the TAB carrier 12 so that it tends to pivot about the pivot line 26. The pivot line 26 should be a point less than half of the length of a TAB carrier. In FIG. 4 the TAB carrier 12 lies in position beneath the stacking magazine 10.

Figure 6:
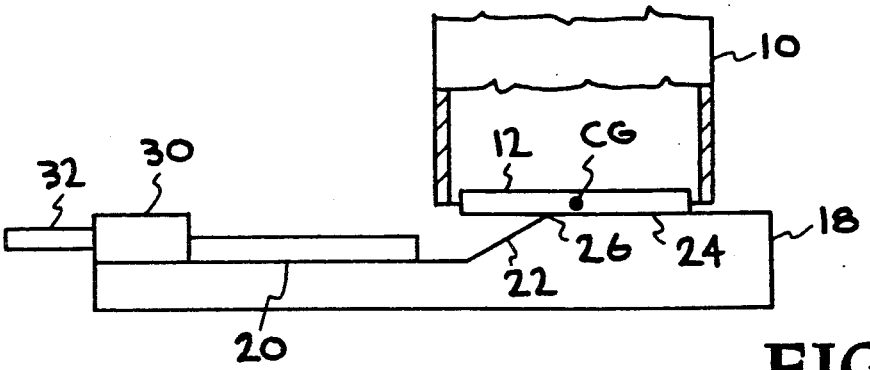
FIG. 6 is an elevational view showing a TAB carrier positioned at the bottom position in the previously-empty stacking TAB-carrier magazine.

FIG. 6 shows the TAB carrier 12 in a horizontal position on the second horizontal surface 24. Because the center of gravity of the TAB carrier 12 is to the right of the pivot line 26, when the pusher block 30 is removed from the trailing edge of the TAB carrier 12, the TAB carrier 12 is pulled downward by the force of gravity and assumes a horizontal position on the second horizontal surface 24 underneath the magazine 10, as shown in Figure.

FIGS. 7–10 show the stacking magazine 10 having a number of previously load TAB carriers contained in a stack 36 within the magazine 10, as indicated in the figure.

Figure 7:
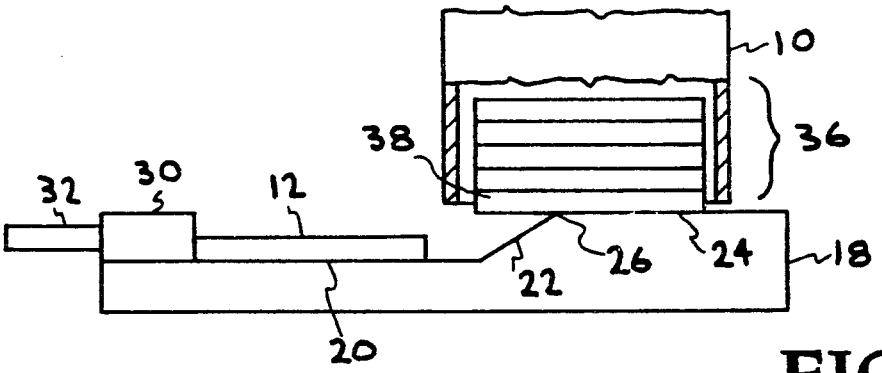
FIG. 7 is an elevational view showing a TAB carrier initially loaded on the first horizontal surface of the loader device, where the stacking magazine has been previously loaded with several TAB carriers.

FIG. 7 is a elevational view showing the TAB carrier 12 initially loaded on the first horizontal surface 20 of the loader device 14. The TAB carrier is to be inserted at the bottom of the stack 36, which has a previously-loaded TAB carrier 38 occupying the lowest position.

Figure 8:
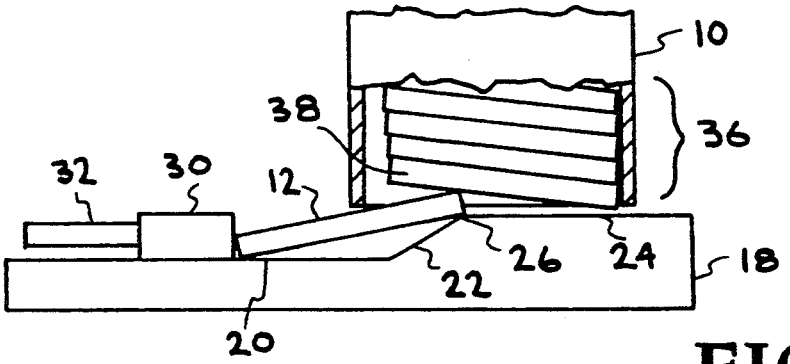
FIG. 8 is an elevational view showing a TAB carrier being initially pushed into the bottom of the magazine, where the stacking magazine has been previously loaded with several TAB carriers and where the leading edge of the TAB carrier has just passed the top of a ramp surface connecting the first horizontal surface with an second elevated horizontal surface.

FIG. 8 shows the TAB carrier 12 with its leading edge located just beyond the pivot line 26 at the top of the ramp surface.22. As the TAB carrier 12 continues to be pushed to the right, the lower surface of the TAB carrier 12 passes over the pivot line 26. The leading edge of the TAB carrier bears against the lower surface of the previously-loaded TAB carrier 38

Figure 9:
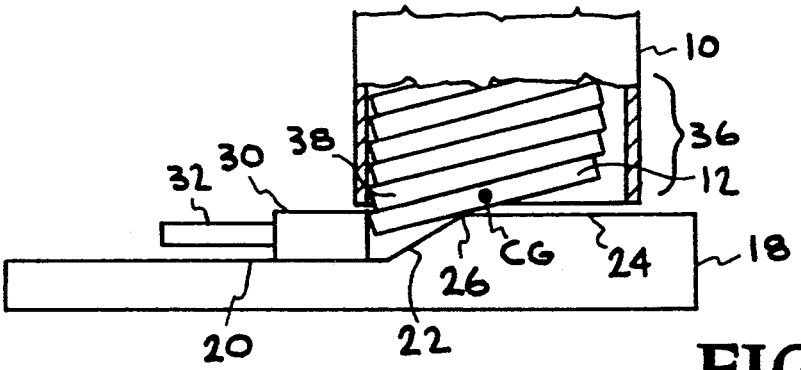
FIG. 9 is an elevational view showing a TAB carrier which has been further pushed into the bottom of a stack of previously-loaded TAB carriers in the stacking TAB-carrier magazine.

FIG. 9 shows the TAB carrier 12 in an inclined position where its center of gravity CG has passed to the right of the pivot point 26 at the top of the ramp 22. The weight of the stack 36 and the force of gravity bear against the TAB carrier 12 so that it pivots about the pivot line 26 as it is pushed up against the lowest TAB carrier 38 in the stacking magazine 10. When the stacking magazine 10 contains a stack of one or more TAB carriers 12, 14, etc. from previous loading steps, the leading edge of the TAB carrier 12 being loaded exerts a force against the lower surface of the lowermost TAB carrier 38 in the stack 36. The weight of the stack bears against the leading edge of the TAB carrier being loaded and provides a force pushing the TAB carrier 12 down, in addition to the gravitational force on the TAB carrier 12 itself.

Figure 10:
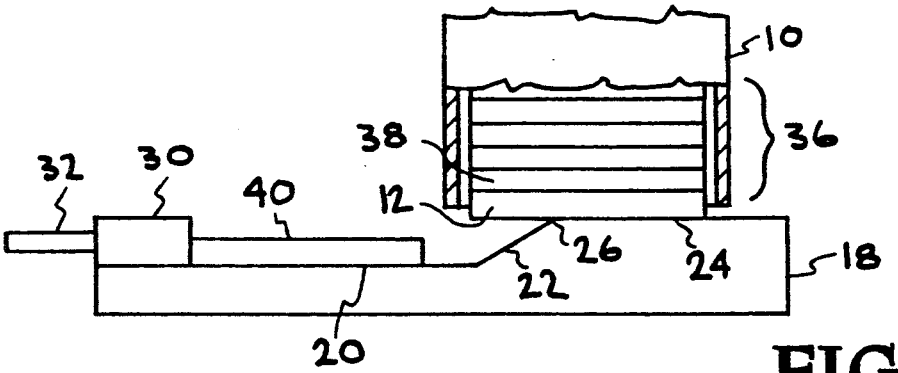
FIG. 10 is an elevational view showing a TAB carrier positioned at the bottom position in the stack of previously-loaded TAB carriers in the stacking TAB-carrier magazine.

FIG. 10 shows the TAB carrier 12 in a horizontal position on the second horizontal surface 24 underneath the magazine 10 with the pusher 30 retracted and ready to load another TAB carrier 40

The stacking magazine has an open top and an open bottom. After loading of the magazine 10 is completed, a plug cap is inserted into the top of the magazine The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. Apparatus for loading a TAB carrier into a bottom-loading stacking magazine, comprising means for applying a horizontal force to the trailing edge of a stiff TAB carrier;

means for elevating the leading edge of said TAB carrier and for inserting the TAB carrier into the open bottom area of the stacking magazine as the TAB carrier is moved by the horizontal force being applied to the trailing edge of the TAB carrier; and means for pivoting the stiff TAB carrier about a pivot line and into a horizontal position within the open bottom area of the stacking magazine.

2. The apparatus of claim 1 wherein the means for pivoting the TAB carrier into a horizontal position includes an elevated horizontal surface, over which is positioned the open bottom area of the stacking magazine, and a ramp surface extending up to the elevated horizontal surface; wherein the intersection of the ramp surface and the horizontal surface form a pivot line about which a TAB carrier pivots as the TAB carrier is moved up the ramp surface and over the horizontal surface.

3. The apparatus of claim 2 wherein the stacking magazine contains one or more previously-loaded TAB carriers positioned adjacent the open bottom area of the stacking magazine and wherein the means for elevating the leading edge of said TAB carrier and for inserting the TAB carrier into the open bottom area of the stacking magazine as the TAB carrier is moved by the horizontal force causes the TAB carrier being loaded to push upward against the lower surface of the lowest previously loaded TAB carrier so that the weight of the one or more previously loaded TAB carriers pivots the TAB carrier being loaded about the pivot line.

4. Apparatus for loading a TAB carrier into a bottom-loading stacking magazine, comprising:

a first horizontal surface on which is initially placed a TAB carrier;

a second horizontal surface, which is elevated above the first horizontal surface and over which is positioned the open bottom area of the stacking magazine;

a ramp surface extending between said first horizontal surface and said elevated second horizontal surface;

the intersection of said ramp surface and the second horizontal surface forming a pivot line about which a TAB carrier pivots as the TAB carrier is moved along the first horizontal surface, up the ramp surface, and over the second horizontal surface;

means for moving the TAB carrier along said first horizontal surface and along the ramp surface and to a point where the center of gravity of the TAB carrier is beyond the pivot line so that the force of gravity pivots the TAB carrier about the pivot line and causes the TAB carrier to lie horizontally on the second surface beneath the open bottom area of the magazine.

5. A method of loading a TAB carrier into a bottom-loading stacking magazine, comprising the steps of:

placing a TAB carrier on a first horizontal surface;

applying a horizontal force to the trailing edge of the TAB carrier;

moving the TAB carrier along the first horizontal surface and along a ramp extending upwardly from the first horizontal surface and into the open bottom area of the stacking magazine to a location where the center of gravity of the TAB carrier is located beyond a pivot line; and pivoting the TAB carrier about the pivot line by the force of gravity so that the TAB carrier lies in a horizontal position on a second horizontal surface beneath the open bottom area of the stacking magazine and so that the TAB carrier takes up a position at the bottom-most position within the stacking magazine.

* * * * *